US011024941B2

(12) United States Patent
Funatsu

(10) Patent No.: US 11,024,941 B2
(45) Date of Patent: Jun. 1, 2021

(54) WINDOW GLASS FOR VEHICLE AND ANTENNA

(71) Applicant: AGC INC., Tokyo (JP)

(72) Inventor: Toshifumi Funatsu, Tokyo (JP)

(73) Assignee: AGC INC., Tokyo (JP)

( * ) Notice: Subject to any disclaimer, the term of this patent is extended or adjusted under 35 U.S.C. 154(b) by 170 days.

(21) Appl. No.: 16/263,610

(22) Filed: Jan. 31, 2019

(65) Prior Publication Data

US 2019/0252758 A1 Aug. 15, 2019

(30) Foreign Application Priority Data

Feb. 9, 2018 (JP) ..... JP2018-022010
Nov. 16, 2018 (JP) ..... JP2018-216002

(51) Int. Cl.
*H01Q 1/12* (2006.01)
*H01Q 1/50* (2006.01)

(52) U.S. Cl.
CPC ..... *H01Q 1/1278* (2013.01); *H01Q 1/1285* (2013.01); *H01Q 1/50* (2013.01)

(58) Field of Classification Search
CPC ..... H04W 4/40; B60R 1/00; H01Q 1/243; H01Q 1/42; H01Q 1/50; H01Q 1/1278; H01Q 1/1285; H01Q 1/38; H01Q 1/22; B60J 1/00
USPC ..... 343/711–713
See application file for complete search history.

(56) References Cited

U.S. PATENT DOCUMENTS 5,926,141 A * 7/1999 Lindenmeier ..... B32B 17/10036 343/704
7,425,926 B2 * 9/2008 Funatsu ..... H01Q 1/1285 343/713
9,755,299 B2 * 9/2017 Lee ..... H01Q 1/325
9,837,707 B2 * 12/2017 Villarroel ..... H01Q 9/42
2008/0283173 A1 * 11/2008 Hisaeda ..... H01Q 1/38 156/102

FOREIGN PATENT DOCUMENTS

JP H04-132717 U 12/1992
JP H05-43608 U 6/1993
JP H11-186826 A 7/1999
JP 2006-151373 A 6/2006
JP 2011-114404 A 6/2011

* cited by examiner

*Primary Examiner* — Alexander H Taningco
*Assistant Examiner* — Amy X Yang
(74) *Attorney, Agent, or Firm* — Foley & Lardner LLP

(57) ABSTRACT

A window glass for a vehicle includes a glass plate; a dielectric having a first surface on a side facing the glass plate, and a second surface; a first electrode arranged between the glass plate and the first surface; a second electrode arranged on the second surface side such that the dielectric is interposed between the first and second electrodes; and an antenna element arranged between the glass plate and the first surface, and connected to the first electrode, the antenna element receiving at least an electromagnetic wave in a frequency band of AM broadcasting, and a coupling capacitance between the first and second electrodes satisfying a condition determined by an antenna capacitance of the antenna element, an input capacitance of an amplifier connected to the second electrode, a voltage value output from the second electrode, and a reception voltage value of the antenna element.

20 Claims, 10 Drawing Sheets

FIG.14

| SHAPE OF ELECTRODE | | OBLONG #1 | SQUARE #3 | OBLONG #2 |
|---|---|---|---|---|
| CAPACITANCE C [pF] | | 54 (WHEN COUPLING LOSS IS 1 dB) | | |
| GLASS THICKNESS [mm] | | 1.6 | 1.6 | 1.6 |
| ELECTRODE 1 | H1 [mm] | 6.77 | 41 | 50 (MAXIMUM WIDTH) |
| | L1 [mm] | 1600 (MAXIMUM LENGTH) | 41 | 33.8 |
| | S1 [$m^2$] | 0.010832 | 0.001681 | 0.00169 |
| ELECTRODE 2 | H2 [mm] | 0.77 | 35 | 44 |
| | L2 [mm] | 1594 | 35 | 27.8 |
| | S2 [$m^2$] | 0.001227 | 0.001225 | 0.001223 |
| OVERLAP AREA RATIO S [%] ($= \frac{S2}{S1} \times 100$) | | 11.33 (MINIMUM) | 72.87 (MAXIMUM) | 72.38 |

WINDOW GLASS FOR VEHICLE AND ANTENNA

CROSS-REFERENCE TO RELATED PATENT APPLICATIONS

The present application is based on and claims priority under 35 U.S.C. § 119 of Japanese applications No. 2018-022010 filed Feb. 9, 2018, and No. 2018-216002 filed Nov. 16, 2018. The contents of the applications are incorporated herein by reference in their entirety.

FIELD OF INVENTION

The disclosure herein generally relates to a window glass for a vehicle and an antenna.

BACKGROUND

Conventionally, an antenna, in which an antenna element and an internal electrode connected to the antenna element are arranged between two glass plates, and an external electrode opposite to the internal electrode is arranged on a surface of the glass plate, has been known (See, for example, Japanese Unexamined Patent Application Publication No. 2011-114404). In the antenna, a reception signal from the antenna element arranged between the two glass plates is extracted from the external electrode via a capacitance coupling between the internal electrode and the external electrode.

However, in the case of receiving electromagnetic waves in a frequency band of AM (amplitude modulation) broadcasting where the frequency is relatively low by the antenna element between the two glass plates, and extracting a signal, which is obtained by receiving, from the external electrode via the capacitance coupling, a coupling loss in the capacitance coupling is large, and a sufficient receiving sensitivity may not be obtained.

SUMMARY

The embodiments of the present application provide a window glass for a vehicle and an antenna, with which a sufficient receiving sensitivity can be obtained, in the case of extracting a signal obtained by receiving an electromagnetic wave in the frequency band of the AM broadcasting via a capacitance coupling.

In some embodiments, a window glass for a vehicle includes a glass plate;

a dielectric having a first surface on a side facing the glass plate, and a second surface on a side opposite to the first surface;

a first electrode arranged between the glass plate and the first surface of the dielectric;

a second electrode arranged on a second surface side of the dielectric such that the dielectric is interposed between the first electrode and the second electrode; and an antenna element arranged between the glass plate and the first surface of the dielectric, and connected to the first electrode, the antenna element receiving at least an electromagnetic wave in a frequency band of amplitude modulation (AM) broadcasting, and when a coupling capacitance between the first electrode and the second electrode is denoted by $C_c$, an antenna capacitance of the antenna element is denoted by $C_a$, an input capacitance of an amplifier connected to the second electrode is denoted by $C_i$, a voltage value, which is lower by x decibels than a voltage value output from the second electrode when the coupling capacitance $C_c$ is infinity is denoted by $v_{xdB}$, and a reception voltage value of the antenna element is denoted by $v_a$, a value of x being 3.0 or less, and the coupling capacitance $C_c$ satisfying formula 1:

[Math 1A]

$$C_c \geq \frac{C_i \times C_a \times \frac{v_{xdB}}{v_a}}{\left(C_a - (C_a + C_i) \times \frac{v_x dB}{v_a}\right)} \quad \text{(formula 1)}$$

In some embodiments, an antenna includes a dielectric having a first surface, and a second surface on a side opposite to the first surface;

a first electrode arranged on a first surface side of the dielectric or inside the dielectric;

a second electrode arranged on a second surface side of the dielectric such that at least a part of the dielectric is interposed between the first electrode and the second electrode; and an antenna element arranged on the first surface side of the dielectric or inside the dielectric, and connected to the first electrode, the antenna element receiving at least an electromagnetic wave in a frequency band of amplitude modulation (AM) broadcasting, and when a coupling capacitance between the first electrode and the second electrode is denoted by $C_c$, an antenna capacitance of the antenna element is denoted by $C_a$ an input capacitance of an amplifier connected to the second electrode is denoted by $C_i$, a voltage value, which is lower than a voltage value output from the second electrode by x decibels when the coupling capacitance $C_c$ is infinity is denoted by $v_{xdB}$, and a reception voltage value of the antenna element is denoted by $v_a$, a value of x being 3.0 or less, and the coupling capacitance $C_c$ satisfying formula 1:

[Math 1B]

$$C_c \geq \frac{C_i \times C_a \times \frac{v_{xdB}}{v_a}}{\left(C_a - (C_a + C_i) \times \frac{v_x dB}{v_a}\right)} \quad \text{(formula 1)}$$

With the antenna or the window glass for a vehicle described herein, in the case of extracting a signal obtained by receiving an electromagnetic wave in the frequency band of the AM broadcasting via a capacitance coupling, a sufficient receiving sensitivity can be obtained.

BRIEF DESCRIPTION OF THE DRAWINGS

Other objects, features and advantages of the present invention will become more apparent from the following detailed description when read in conjunction with the accompanying drawings, in which:

FIG. 14 is a diagram depicting an example of a result of simulation for dimensions of respective parts for each shape of the electrode, where the coupling capacitance $C_c$ is 54 pF.

DETAILED DESCRIPTION

In the following, with reference to drawings, embodiments for implementing the present invention will be described. Note that in each embodiment, a direction, such as parallel, a right angle, orthogonal, horizontal, vertical, up-down, right-left, or the like, allows a deviation enough to keep the effect of the present invention. Moreover, a shape of a corner portion of an antenna element is not limited to a right angle, but may be arcuate and rounded. Moreover, as a window glass for a vehicle, to which the present invention can be applied, a rear glass installed in a rear part of a vehicle is preferable. However, the window glass for a vehicle to which the present invention can be applied may be, for example, a front windshield installed in a front part of the vehicle, a side glass installed in a side part of the vehicle, or a roof glass installed in a ceiling part of the vehicle.

Moreover, in each mode, a direction parallel to an X-axis (X-axis direction), a direction parallel to a Y-axis (Y-axis direction), and a direction parallel to a Z-axis (Z-axis direction) indicate the right-left direction of the glass plate (horizontal direction), the up-down direction of the glass plate (vertical direction), and a direction orthogonal to a surface of the glass plate (also referred to as a normal direction), respectively. The X-axis direction, the Y-axis direction and the Z-axis direction are orthogonal to each other.

Figure 1:
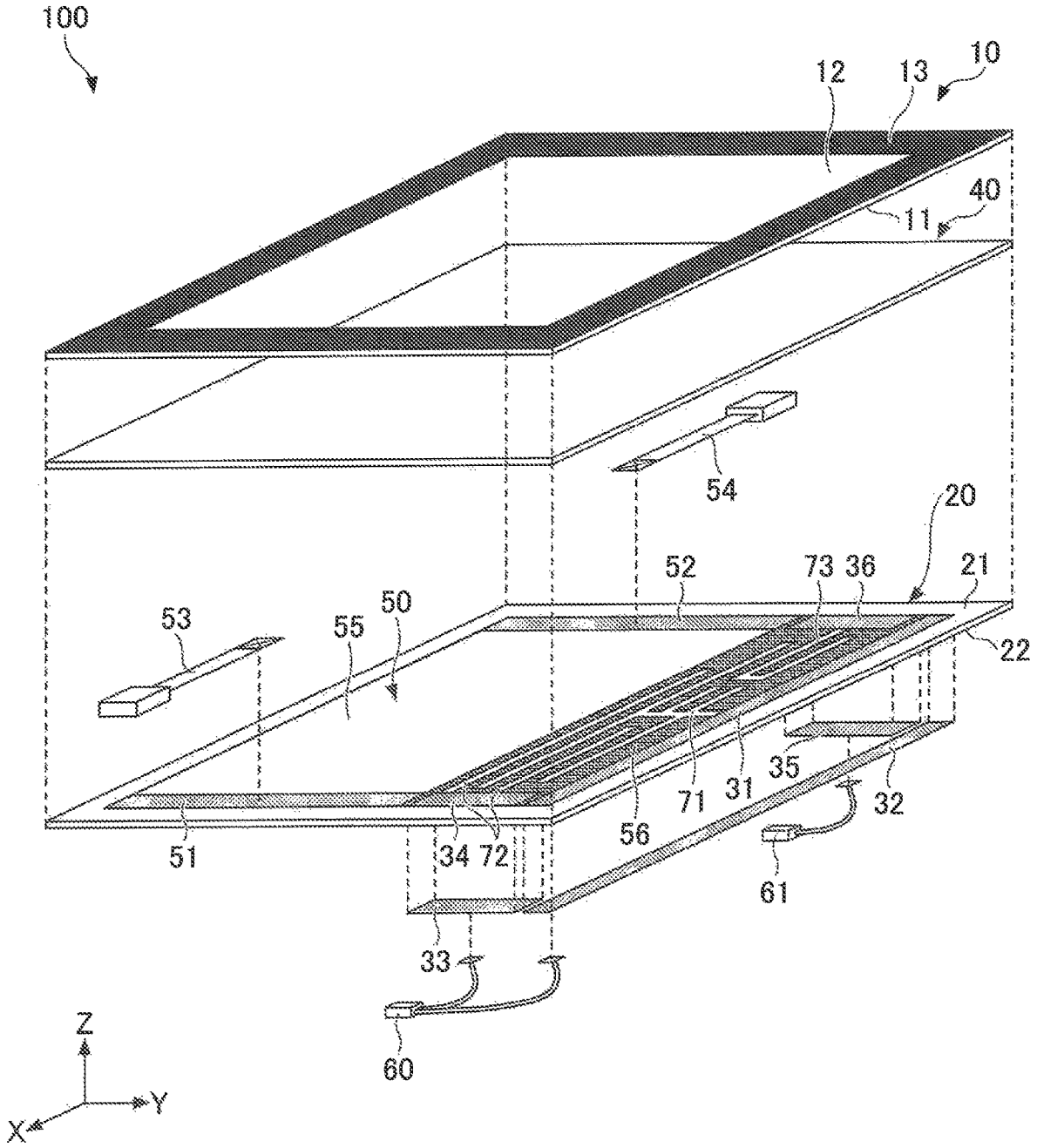
FIG. 1 is an exploded perspective view depicting an example of a configuration of a window glass for a vehicle according to a first embodiment.

FIG. 1 is an exploded perspective view depicting an example of a configuration of a window glass for a vehicle according to a first embodiment. In FIG. 1, a positive side in the Z-axis direction represents a vehicle exterior side, and a negative side in the Z-axis direction represents a vehicle interior side. A window glass 100 has a structure of laminated glass, in which a glass plate 10 arranged on the vehicle exterior side and a glass plate 20 arranged on the vehicle interior side are bonded to each other via an intermediate film 40. FIG. 1 illustrates elements of the window glass 100 being separated in a normal direction to a surface of the glass plate 10 or the glass plate 20.

The window glass 100 includes the glass plate 10 arranged on the vehicle exterior side; the glass plate 20 arranged on the vehicle interior side; an interior electrode 31 and an antenna element 71 arranged inside the laminated glass; and an exterior electrode 32 arranged on a vehicle interior side outer surface of the laminated glass.

The glass plate 10 and the glass plate 20 are transparent plate-like dielectrics. Any one of or both the glass plate 10 and the glass plate 20 may be translucent. The glass plate 10 is an example of a first glass plate, and the glass plate 20 is an example of a second glass plate.

The glass plate 10 has a plate face 11, and a plate face 12 on a side opposite to the plate face 11 in the Z-axis direction. The plate face 11 represents a surface of the glass plate 10 on the vehicle interior side, and the plate face 12 represents a surface of the glass plate 10 on the vehicle exterior side. Particularly, the plate face 12 corresponds to a vehicle exterior side outer surface of the laminated glass.

The glass plate 20 has a plate face 21 on a side facing the plate face 11 of the glass plate 10, and a plate face 22 on a side opposite to the plate face 21 in the Z-axis direction. The plate face 21 represents a surface of the glass plate 20 on the vehicle exterior side. The plate face 22 represents a surface of the glass plate 20 on the vehicle interior side. Particularly, the plate face 22 corresponds to a vehicle interior side outer surface of the laminated glass.

The intermediate film 40 is a transparent or translucent dielectric intervening between the glass plate 10 and the glass plate 20. The glass plate 10 and the glass plate 20 are bonded to each other by the intermediate film 40. A material configuring the intermediate film 40 includes, for example, thermoplastic polyvinylbutyral. Note that a dielectric constant of the intermediate film 40 is preferably 2.8 or more and 3.5 or less.

The internal electrode 31 is a conductor arranged between the plate face 11 of the glass plate 10 and the plate face 21 of the glass plate 20. The internal electrode 31 is an example of a first electrode. The internal electrode 31 according to the embodiment has a linear portion having a predetermined width with a longitudinal direction directed in the X-axis direction, which will be a vehicle width direction, and extends from one side edge of the glass plate 20 toward the other side edge, along an upper edge in the Y-axis direction of the glass plate 20. Moreover, in the embodiment, the internal electrode 31 is formed contacting the plate face 21 of the glass plate 20.

The external electrode 32 is a conductor arranged on the plate face 22 side of the glass plate 20 such that the glass plate 20 that is a dielectric is interposed between the internal electrode 31 and the external electrode 32. The external electrode 32 is an example of a second electrode. The external electrode 32 has a linear portion having a predetermined width with a longitudinal direction directed in the X-axis direction, which will be the vehicle width direction, and extends from one side edge of the glass plate 20 toward the other side edge, along the upper edge in the Y-axis direction of the glass plate 20. Moreover, in the embodiment, the external electrode 32 is formed contacting the plate face 22 of the glass plate 20. Note that a mode of "extending along an upper edge" may be a mode of contacting the upper edge, or may be a mode of separating from the upper edge.

The antenna element 71 is a conductor arranged between the plate face 11 of the glass plate 10 and the plate face 21 of the glass plate 20, and connected to the internal electrode 31. The antenna element 71 is designed, i.e. a shape and a dimension thereof are determined, so as to receive at least an electromagnetic wave in a frequency band of amplitude modulation (AM) broadcasting (e.g. within a band from 500 kHz to 1800 kHz). However, as long as the antenna element 71 is formed so as to receive at least an electromagnetic wave in the frequency band of the AM broadcasting (500 kHz to 1800 kHz), the shape and the dimension thereof are not limited to those illustrated in FIG. 1.

For example, the antenna element 71 may be formed suitable for receiving an electromagnetic wave in a medium frequency (MF) band that includes the frequency band of the AM (amplitude modulation) broadcasting. Alternatively, the antenna element 71 may be formed as a shared antenna element that receives electromagnetic waves both in the MF band and in a high frequency (HF) band. Note that the MF band means a frequency band of 300 kHz or more and 3 MHz or less. The HF band means a frequency band of 3 MHz or more and 30 MHz or less, and is also referred to as a short wave (SW) band. Moreover, the antenna element 71 may be formed as a shared antenna element that receives at least one of the electromagnetic wave in the MF band, an FM (frequency modulation) broadcasting wave, a DAB (Digital Audio Broadcast) wave, and a terrestrial digital television broadcast wave.

FIG. 1 is a diagram depicting an example of a mode in which the antenna element 71 is formed on a conductive film 50 arranged between the glass plate 10 and the glass plate 20. In the embodiment illustrated in FIG. 1, the conductive film 50 is a transparent or translucent conductor arranged between the intermediate film 40 and the glass plate 20, and may be, for example, a metallic film such as an Ag film, a metal oxide film such as an ITO (indium tin oxide) film, a resin film containing conductive fine particles, or a stacked film stacking a plurality of types of films. The conductive film 50 may be coated on a resin film made of polyethylene terephthalate or the like by a vapor deposition process or the like.

In the embodiment illustrated in FIG. 1, the conductive film 50 around the conductor that will become the antenna element 71 is removed. Thus, the conductor that will become the antenna element 71 is left as the conductive film 50, and the antenna element 71 is formed of the conductive film 50. That is, in the embodiment illustrated in FIG. 1, the conductive film 50 includes the antenna element 71. A lattice part 56 is a region in which an electric resistance is increased by removing the conductive film 50 around the conductor that will become the antenna element 71.

On the conductive film 50, for example, a heater 55 is formed. The heater 55 heats the window glass 100 when a direct current voltage is applied between the pair of bus bars 51 and 52, and snow melting, ice melting and defogging by the window glass 100 becomes possible. For example, the bus bar 51 is connected to a negative electrode of the direct current power source via a flat wire 53, and the bus bar 52 is connected to a positive electrode of the direct current power source via a flat wire 54. Alternatively, the conductive film 50 may be a heat-ray reflecting film that reflects a heat ray entering from outside the vehicle. However, the usage of the conductive film 50 is not limited to this.

On the conductive film 50, at least one antenna element other than the antenna element 71 may be formed. For example, FIG. 1 depicts antenna elements 72 and 73 in addition to the antenna element 71. That is, in the embodiment, illustrated in FIG. 1, the conductive film 50 includes the antenna elements 72 and 73. The antenna elements 72 and 73 are formed so as to receive an electromagnetic wave of a frequency band with a frequency higher than that of the HF band, respectively. The electromagnetic wave of the frequency band with a frequency higher than that of the HF band, includes, for example, a terrestrial digital television broadcast wave, a DAB (Digital Audio Broadcast) wave, or an FM (frequency modulation) broadcasting wave.

In the embodiment, illustrated in FIG. 1, the antenna element 71 is connected to the internal electrode 31, and the antenna element 72 is connected to the internal electrode 34, and the antenna element 73 is connected to the internal electrode 36. The internal electrodes 31, 34 and 36 may be portions formed of the conductive film 50. In this case, the conductive film 50 includes the internal electrodes 31, 34 and 36. However, at least one of the internal electrodes 31, 34 and 36 may be a portion formed of a conductor that is different from the conductive film 50. Similarly, in the embodiment, illustrated in FIG. 1, the antenna elements 71, 72, and 73 are portions formed of the conductive film 50, respectively. However, at least one of the antenna elements 71, 72 and 73, may be a portion formed of a conductor that is different from the conductive film 50.

As the aforementioned conductor that is different from the conductive film 50, for example, at least one of the antenna elements 71, 72 and 73 may be formed by printing a paste including conductive metal (e.g. silver paste) on a plate surface 21 of the glass plate 20 (or a plate surface 11 of the glass plate 10), and baking the paste. The same applies to any of the internal electrodes 31, 34 and 36. Alternatively, at least one of the antenna elements 71, 72 and 73 may be formed of a wire enclosed between the glass plate 20 and the glass plate 10.

At least a part of the internal electrode 31, to which the antenna element 71 is connected, faces the external electrode 32 via the glass plate 20. To the external electrode 32, a first input part of an amplifier 60 is connected. Then, a signal obtained by being received at the antenna element 71 is input to the first input part of the amplifier 60 via a capacitive coupling between the internal electrode 31 and the external electrode 32.

Similarly, at least a part of the internal electrode 34, to which the antenna element 72 is connected, faces the external electrode 33 via the glass plate 20. To the external electrode 33, a second input part of the amplifier 60 is connected. Then, a signal obtained by being received at the antenna element 72 is input to the second input part of the amplifier 60 via a capacitive coupling between the internal electrode 34 and the external electrode 33.

Similarly, at least a part of the internal electrode 36, to which the antenna element 73 is connected, faces the external electrode 35 via the glass plate 20. To the external electrode 35, an input part of an amplifier 61 is connected. Then, a signal obtained by being received at the antenna element 73 is input to the input part of the amplifier 61 via a capacitive coupling between the internal electrode 36 and the external electrode 35.

Moreover, the glass plate 10 may be provided with a light shielding film 13 that shields visible light. The light shielding film 13 is arranged on an external peripheral portion of the glass plate 10. The light shielding film 13 overlaps with at least one of the internal electrode 31 and the external electrode 32 in the thickness direction of the glass plate 10. Specifically, the light shielding film 13 includes a ceramic film such as a black ceramic film. In the case where, among the internal electrode, the external electrode, the antenna element and the bus bar, there is a part overlapping with the light shielding film 13 in a planar view of the glass plate 10, when the window glass 100 is viewed from outside the vehicle, it is difficult to visually recognize the overlapping part. Thus, the design property of the window glass 100 and the vehicle is enhanced. Particularly, as described later, because the internal electrode 31 and the external electrode 32 have relatively large areas, the light shielding film 13 only need to overlap with at least one of the internal electrode 31 and the external electrode 32, preferably overlaps with an electrode having a large area of the internal electrode 31 and the external electrode 32, and more preferably overlaps with both the internal electrode 31 and the external electrode 32. The electrode having a larger area from among the internal electrode 31 and the external electrode 32 only needs to have an area of 1675 $mm^2$ or more, preferably 1682 $mm^2$ or more, more preferably 1705 $mm^2$ or more, and further preferably 1863 $mm^2$ or more.

Figure 2:
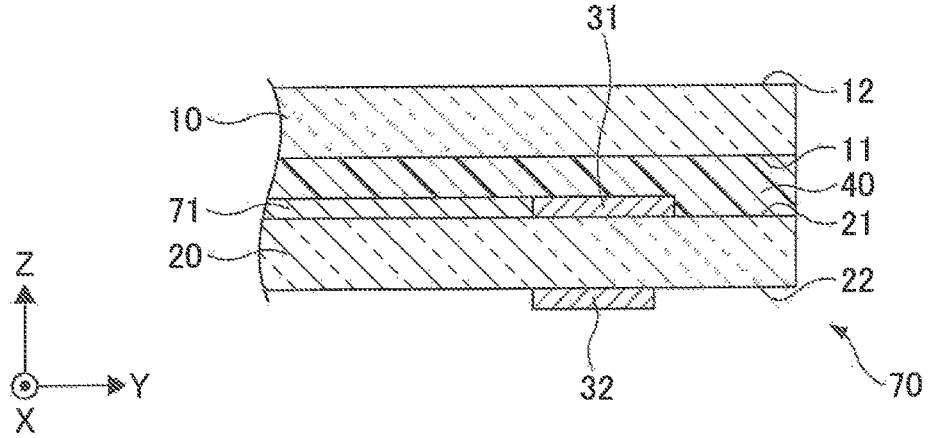
FIG. 2 is a cross-sectional view depicting an example of a configuration of a window glass for a vehicle according to the first embodiment.

FIGS. 2 to 7 depict a variation of the mode of lamination of the window glass for a vehicle on which the antenna 70 according to the embodiment is arranged. FIG. 2 corresponds to a cross-sectional view of the configuration illustrated in FIG. 1.

Figure 3:
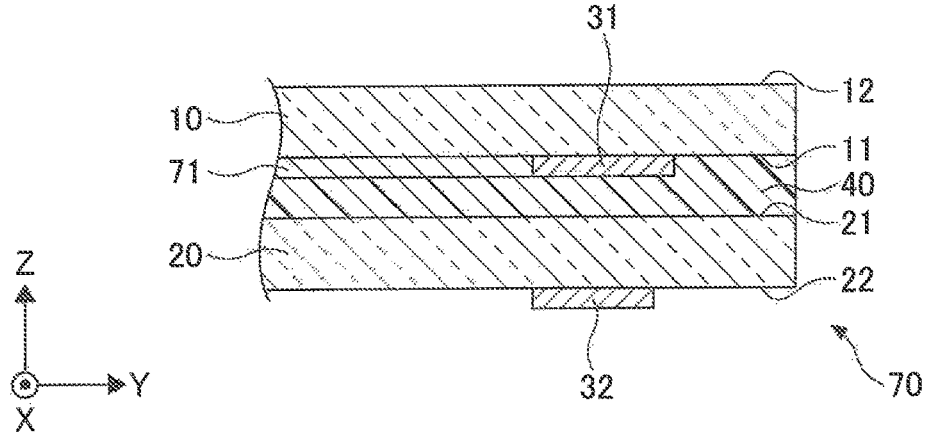
FIG. 3 is a cross sectional view depicting an example of a configuration of a window glass for a vehicle according to a second embodiment.
Figure 4:
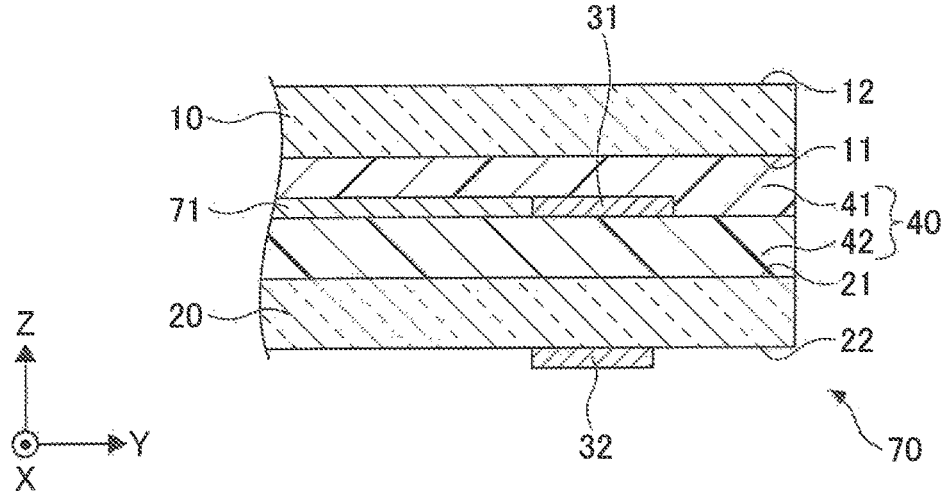
FIG. 4 is a cross sectional view depicting an example of a configuration of a window glass for a vehicle according to a third embodiment.

In FIGS. 2 to 4, the antenna element 71 and the internal electrode 31 are arranged between the glass plate 10 and the glass plate 20. The internal electrode 31 and the external electrode 32 are arranged so as to overlap with each other via the glass plate 20, in a planar view in the thickness direction of the glass plate 20 (Z-axis direction). Moreover, the antenna element 71 and the internal electrode 31 contact an intermediate film 40 arranged between the glass plate 10 and the glass plate 20.

A value of a ratio of areas where the internal electrode 31 and the external electrode 32 overlap with each other ("ratio S" which will be described later) is preferably large, because an exposure (extrusion) of electrode from the overlapping part can be made smaller, it becomes easier to cause the electrodes to overlap with the light shielding film 13, and it becomes easier to reduce a coupling loss. According to a result of simulations, which will be described later, under a condition where the electrodes have predetermined areas, the ratio of an area of the overlapping part to a larger area from among areas of the internal electrode 31 and the external electrode 32 ("ratio S", expressed as a percentage where said larger area=100%, which will be further described later) is preferably 1.5% or more, in order to reduce the coupling loss. Moreover, in addition to the reduction of the coupling loss between the internal electrode 31 and the external electrode 32, in order to reduce the exposure (extrusion) of electrode, as described above, the ratio of overlap ("ratio S" which will be described later) is preferably 10% or more, more preferably 40% or more, and further preferably 70% or more.

FIG. 2 is a diagram depicting a configuration in which the antenna element 71 and the internal electrode 31 are formed on a plate surface 21 of the glass plate 20. For example, the antenna element 71 and the internal electrode 31 are formed as a conductive film coated on the plate surface 21 by performing a deposition process on the plate surface 21 of the glass plate 20.

FIG. 3 is a diagram depicting a configuration in which the antenna element 71 and the internal electrode 31 are formed on a plate surface 11 of the glass plate 10. For example, the antenna element 71 and the internal electrode 31 are formed as a conductive film coated on the plate surface 11 by performing a deposition process on the plate surface 11 of the glass plate 10. As illustrated in FIG. 3, between the internal electrode 31 and the external electrode 32, in addition to the glass 20, the intermediate film 40 may be present.

FIG. 4 is a diagram depicting a configuration in which the antenna element 71 and the internal electrode 31 are located between an intermediate film 41 and an intermediate film 42. The intermediate film 41 is an example of a first layer included in the intermediate film 40, and the intermediate film 42 is an example of a second layer included in the intermediate film 40. For example, the antenna element 71 and the internal electrode 31 are formed in a conductive film interposed between the intermediate film 41 contacting the plate surface 11 of the glass plate 10, and the intermediate film 42 contacting the plate surface 21 of the glass plate 20. As illustrated in FIG. 4, between the internal electrode 31 and the external electrode 32, in addition to the glass plate 20, the intermediate film 42 may be present.

Figure 5:
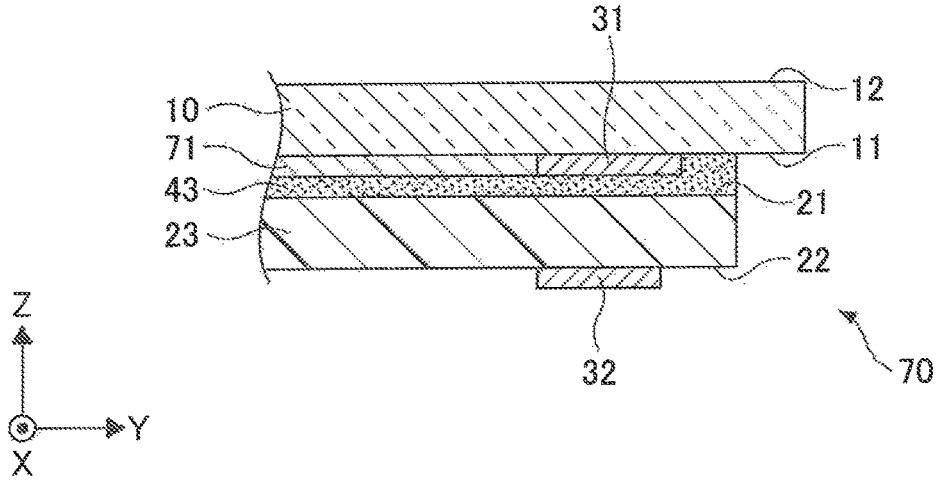
FIG. 5 is a cross sectional view depicting an example of a configuration of a window glass for a vehicle according to a fourth embodiment.
Figure 6:
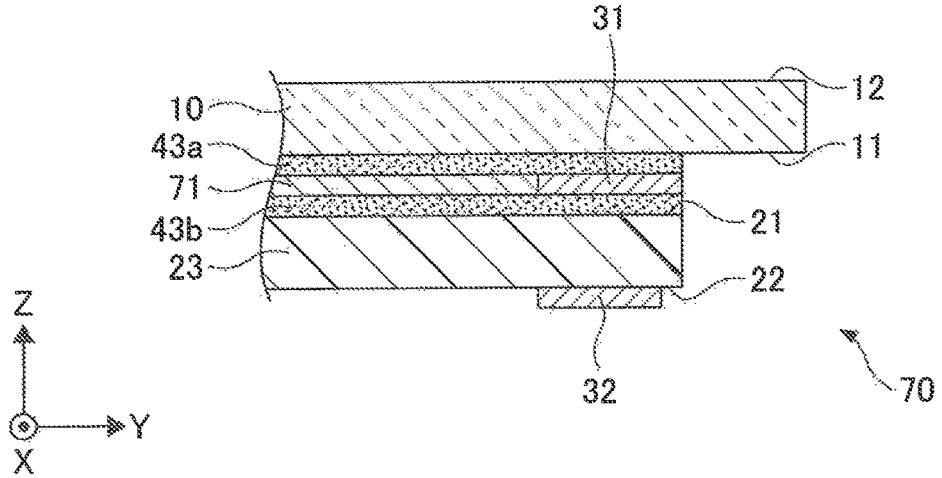
FIG. 6 is a cross sectional view depicting an example of a configuration of a window glass for a vehicle according to a fifth embodiment.
Figure 7:
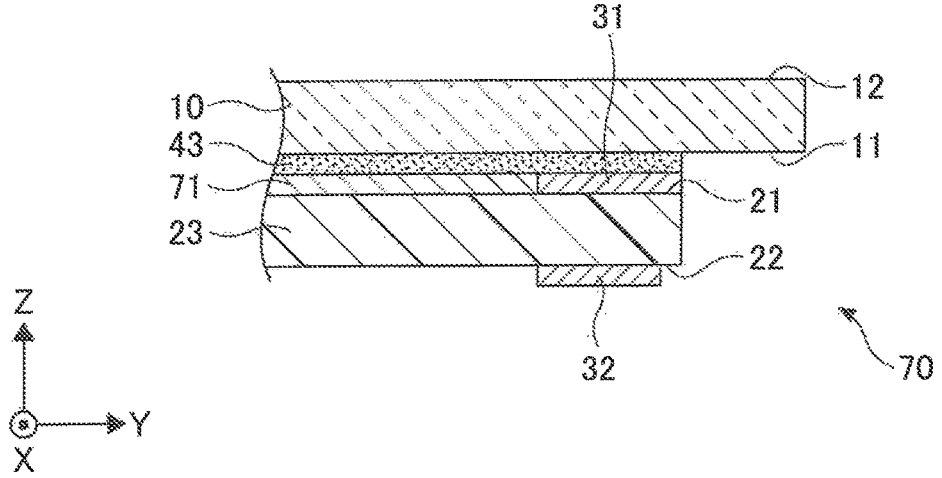
FIG. 7 is a cross sectional view depicting an example of a configuration of a window glass for a vehicle according to a sixth embodiment.

Moreover, as illustrated in FIGS. 5 to 7, the window glass for a vehicle according to the disclosure is not limited to a laminated glass. In this case, a dielectric, present between the internal electrode 31 and the external electrode 32, may not have the same size as the glass plate 10 in a planar view in the thickness direction (Z-axis direction), and may be a dielectric substrate or a dielectric film having a size, at least, enough to form the external electrode 32.

In FIGS. 5 to 7, the antenna element 71 and the internal electrode 31 are arranged between the glass plate 10 and a dielectric substrate 23. The internal electrode 31 and the external electrode 32 are arranged so as to overlap with each other via the dielectric substrate 23, in a planar view in the thickness direction (Z-axis direction) of the dielectric substrate 23. The dielectric substrate 23 is, for example, a printed substrate made of resin (e.g. a glass epoxy substrate in which a copper foil adheres to an FR4 (Flame Retardant Type 4)). The dielectric substrate 23 may be replaced by a dielectric film.

FIG. 5 is a diagram depicting an example of a configuration in which the antenna element 71 and the internal electrode 31 are formed on the plate surface 11 of the glass plate 10. For example, the antenna element 71 and the internal electrode 31 are formed as a conductive film coated on the plate surface 11 by performing a deposition process on the plate surface 11 of the glass plate 10. The external electrode 32 is provided on the plate surface 22 of the dielectric substrate 23. The dielectric substrate 23 is bonded to the conductive film, in which the antenna element 71 and the internal electrode 31 are formed, via a bonding layer 43, so that the external electrode 32 faces the internal electrode 31.

FIG. 6 is a diagram depicting another example of the configuration in which antenna element 71 and the internal electrode 31 are formed on the plate surface 11 of the glass plate 10. For example, the conductive film, in which the antenna element 71 and the internal electrode 31 are formed, is bonded to the plate surface 11 via a bonding layer 43*a*. The external electrode 32 is provided on the plate surface 22 of the dielectric substrate 23. The dielectric substrate 23 is bonded to the conductive film in which the antenna element 71 and the internal electrode 31 are formed, via a bonding layer 43*b*, so that the external electrode 32 faces the internal electrode 31.

FIG. 7 is a diagram depicting an example of a configuration in which the dielectric substrate 23 that is a component of the antenna 70 is bonded to the plate surface 11 of the glass plate 10 via the bonding layer 43. The antenna 70 is provided with the dielectric substrate 23 on which the antenna element 71, the internal electrode 31 and the external electrode 32 are formed. For example, the dielectric substrate 23 includes the plate surface 22 on which the external electrode 32 is formed so that at least a part of a dielectric portion is interposed between the plate surface 21 on which the antenna element 71 and the internal electrode 31 are formed, and the internal electrode 31. At least one of the antenna element 71 and the internal electrode 31 may be provided in a form of being embedded inside the dielectric substrate 23.

In this way, in the antenna 70 and the window glass 100 according to the embodiment, at least a part of the internal electrode 31, to which the antenna element 71 is connected, faces the external electrode 32 via a dielectric (a glass plate or a dielectric substrate). Then, a signal obtained by being received at the antenna element 71 is extracted from the external electrode 32 via a capacitive coupling between the internal electrode 31 and the external electrode 32. The signal extracted from the external electrode 32 is transferred to a (first) inputting part of an amplifier 60 (See FIG. 1) via a conductive member that is connected enabling conduction with the external electrode 32. The conductive member includes specifically a feeder wire such as an AV wire or a coaxial cable.

A coaxial cable is employed as the feeder wire, a core wire of the coaxial cable (internal conductor) is connected to the external electrode 32, and an external conductor of the coaxial cable is connected to the ground such as a vehicle body. Moreover, a connector for connecting the amplifier 60 to the external electrode 32 may be used. The connector is, for example, mounted on the external electrode 32. Alternatively, the amplifier 60 may be implemented in the connector.

In this way, the signal obtained by being received at the antenna element 71 is extracted from the external electrode 32 via the capacitive coupling between the internal electrode 31 and the external electrode 32. The (first) input part of the amplifier 60 is connected to the external electrode 32 directly or indirectly. The amplifier 60 amplifies the signal extracted from the external electrode 32, and outputs the amplified signal to a signal processing circuit (not shown) mounted on the vehicle.

Figure 8:
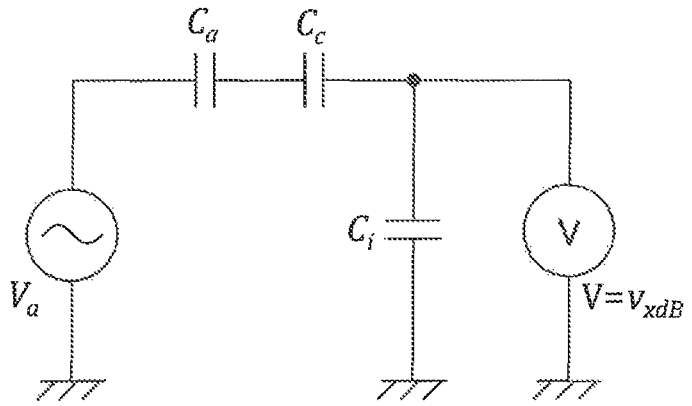
FIG. 8 is a diagram depicting an example of an equivalent circuit from an antenna to an amplifier.

An equivalent circuit from the antenna element 71 to the amplifier 60 can be expressed by a circuit illustrated in FIG. 8. In FIG. 8, the coupling capacitance between the internal electrode 31 and the external electrode 32 is denoted by $C_c$, an antenna capacitance of the antenna element 71 is denoted by $C_a$ and an input capacitance of the amplifier 60 connected to the external electrode 32 is denoted by $C_i$. Moreover, an electric voltage value, which is lower than a voltage value V output from the external electrode 32, when the coupling capacitance is infinity, by x decibels, is denoted by $v_{xdB}$, and a reception voltage value of the antenna element 71 is denoted by $v_a$. Note that x is 3.0 or less. At this time, when the coupling capacitance $C_c$ satisfies the following formula 1, a coupling loss in the coupling capacitance between the internal electrode 31 and the external electrode 32 is x decibels or less.

[Math 1C]

$$C_c \geq \frac{C_i \times C_a \times \frac{v_{xdB}}{v_a}}{\left(C_a - (C_a + C_i) \times \frac{v_x dB}{v_a}\right)} \quad \text{(formula 1)}$$

Ca represents a capacitance between the antenna element 71 and the ground such as a vehicle body. $C_i$ represents an input capacitance between the input part of the amplifier 60 and the ground such as a vehicle body. "When the coupling capacitance $C_c$ is infinity" means that the internal electrode 31 and the external electrode 32 are directly connected to each other via a conductor, without the capacitive coupling. That is, it represents a state where the coupling loss in the coupling capacitance between the internal electrode 31 and the external electrode 32 is zero. In the following, "the coupling loss in the coupling capacitance between the internal electrode 31 and the external electrode 32" will be also referred to simply as a "coupling loss".

The state where the coupling capacitance $C_c$ is infinity is an ideal state in which a coupling loss is absent in the capacitive coupling. Because the coupling loss in the coupling capacitance is smaller in accordance with the coupling capacitance $C_c$ being larger, a divided voltage applied to the input capacitance $C_i$ (voltage input to the amplifier 60) can be prevented from decreasing due to the coupling loss. Thus, when the coupling capacitance $C_c$ is set so as to satisfy the formula 1, a voltage input to the amplifier 60 can be prevented from decreasing due to the coupling loss. Thus, in the case of extracting, via a capacitive coupling, a signal obtained by receiving an electromagnetic wave in the frequency band of the AM broadcasting, an electric voltage input to the amplifier 60 is secured, and a sufficient receiving sensitivity is obtained in the amplifier 60. Note that regarding the coupling loss of x decibels, the value of x is preferably 2.0 or less, more preferably 1.0 or less, and further preferably 0.5 or less.

Figure 9:
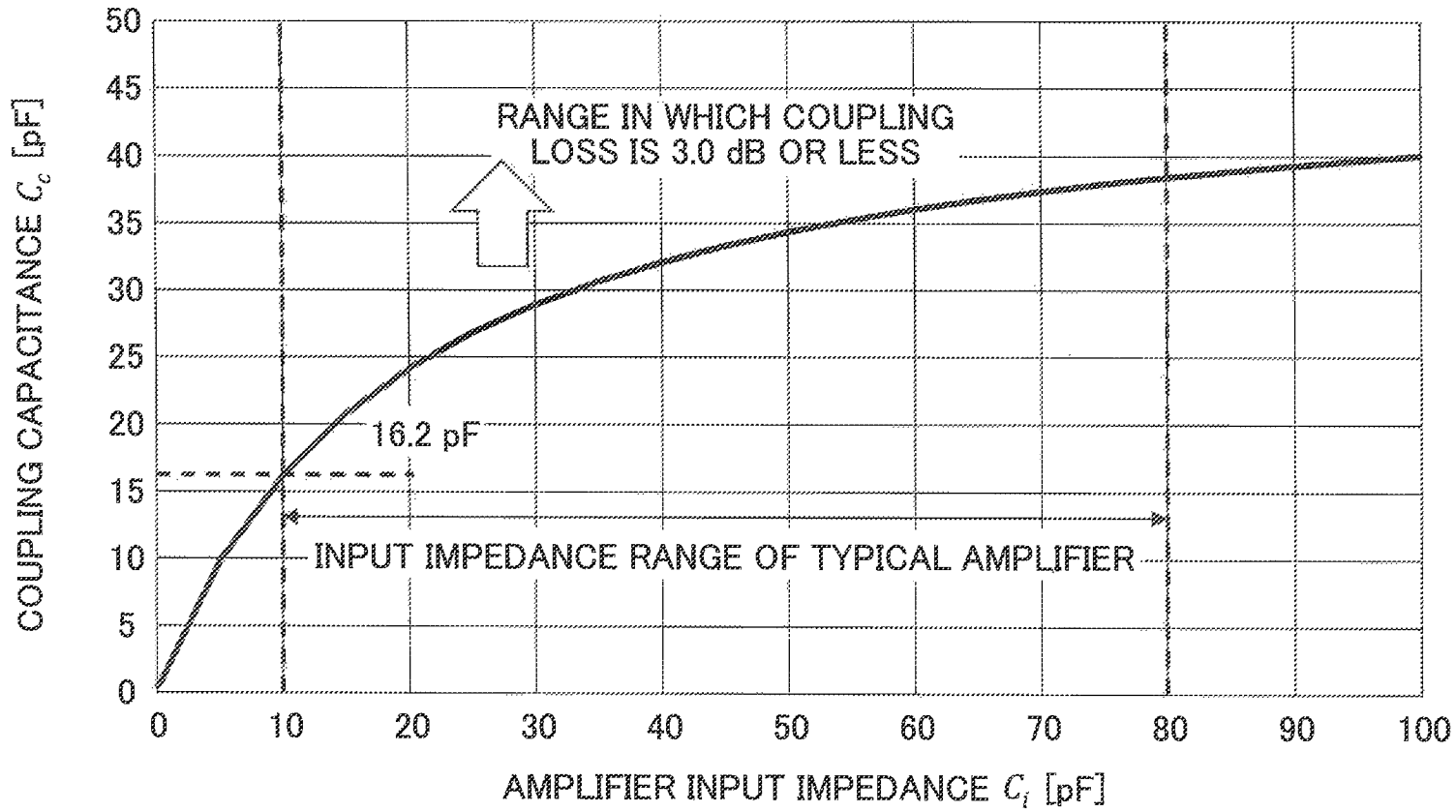
FIG. 9 is a diagram showing an example of a result of simulation measuring a relation between an input capacitance of the amplifier and the coupling capacitance, where a coupling loss is 3.0 dB.
Figure 10:
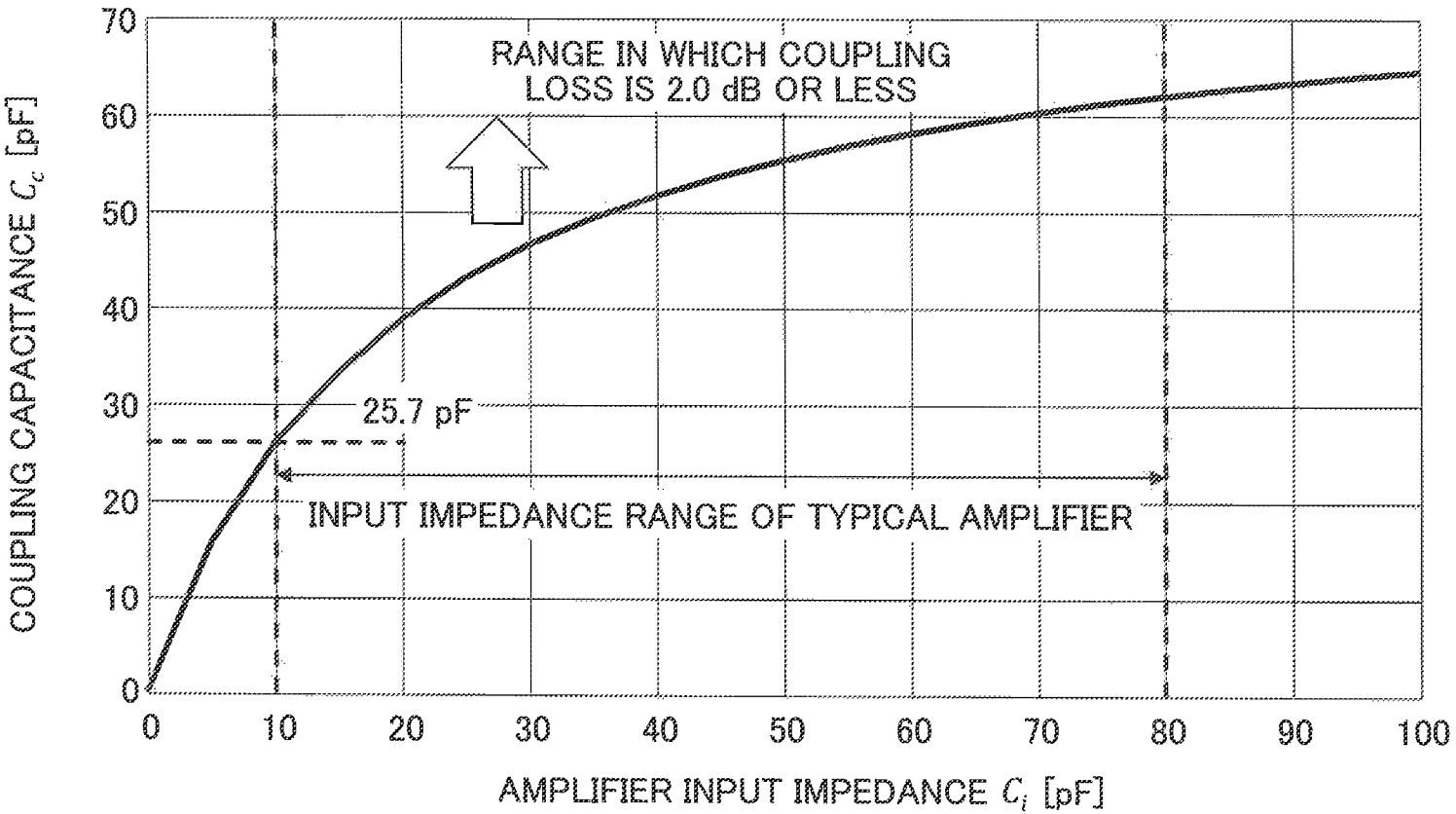
FIG. 10 is a diagram showing an example of a result of simulation measuring a relation between the input capacitance of the amplifier and the coupling capacitance, where the coupling loss is 2.0 dB.
Figure 11:
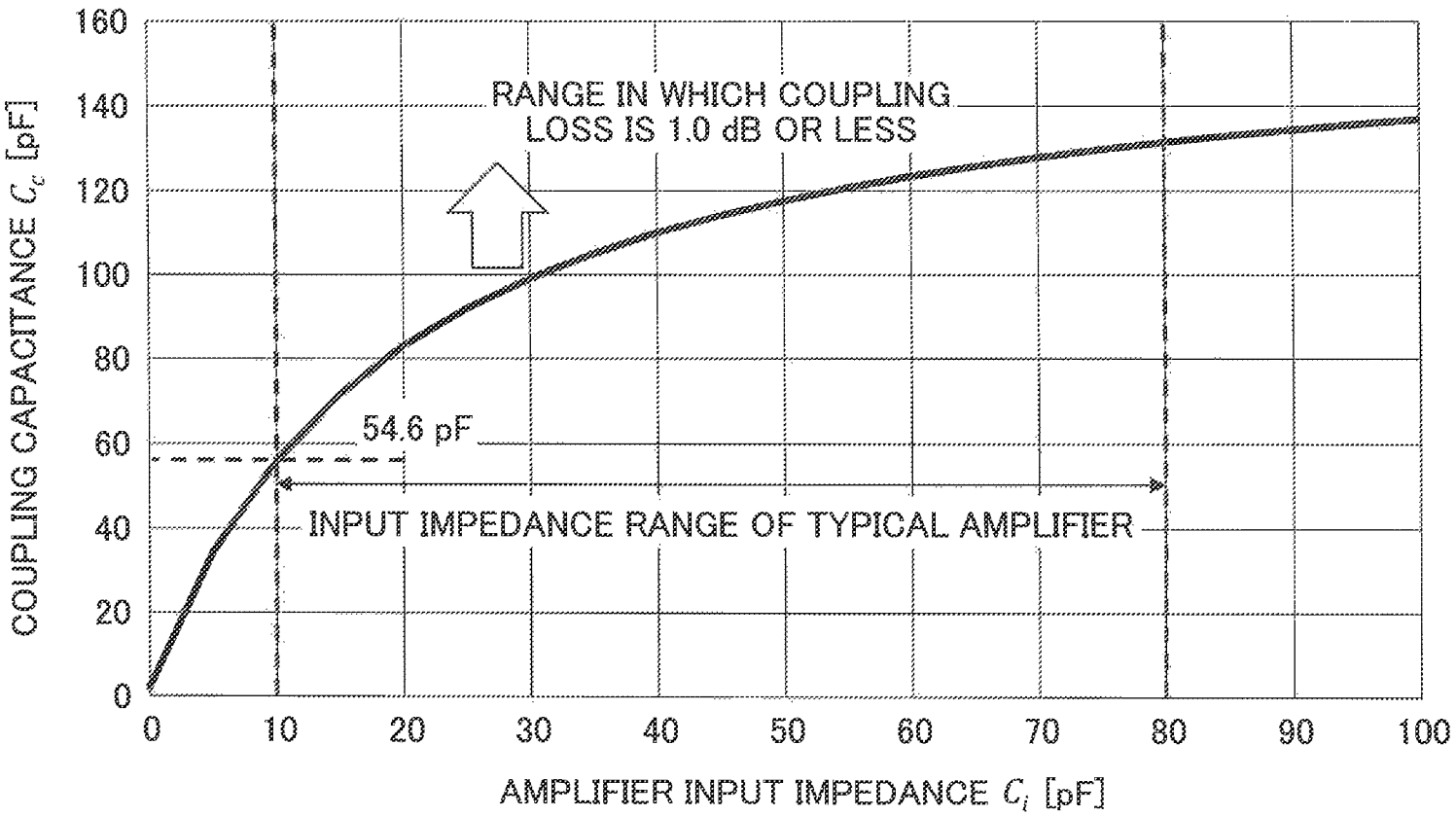
FIG. 11 is a diagram showing an example of a result of simulation measuring a relation between the input capacitance of the amplifier and the coupling capacitance, where the coupling loss is 1.0 dB.
Figure 12:
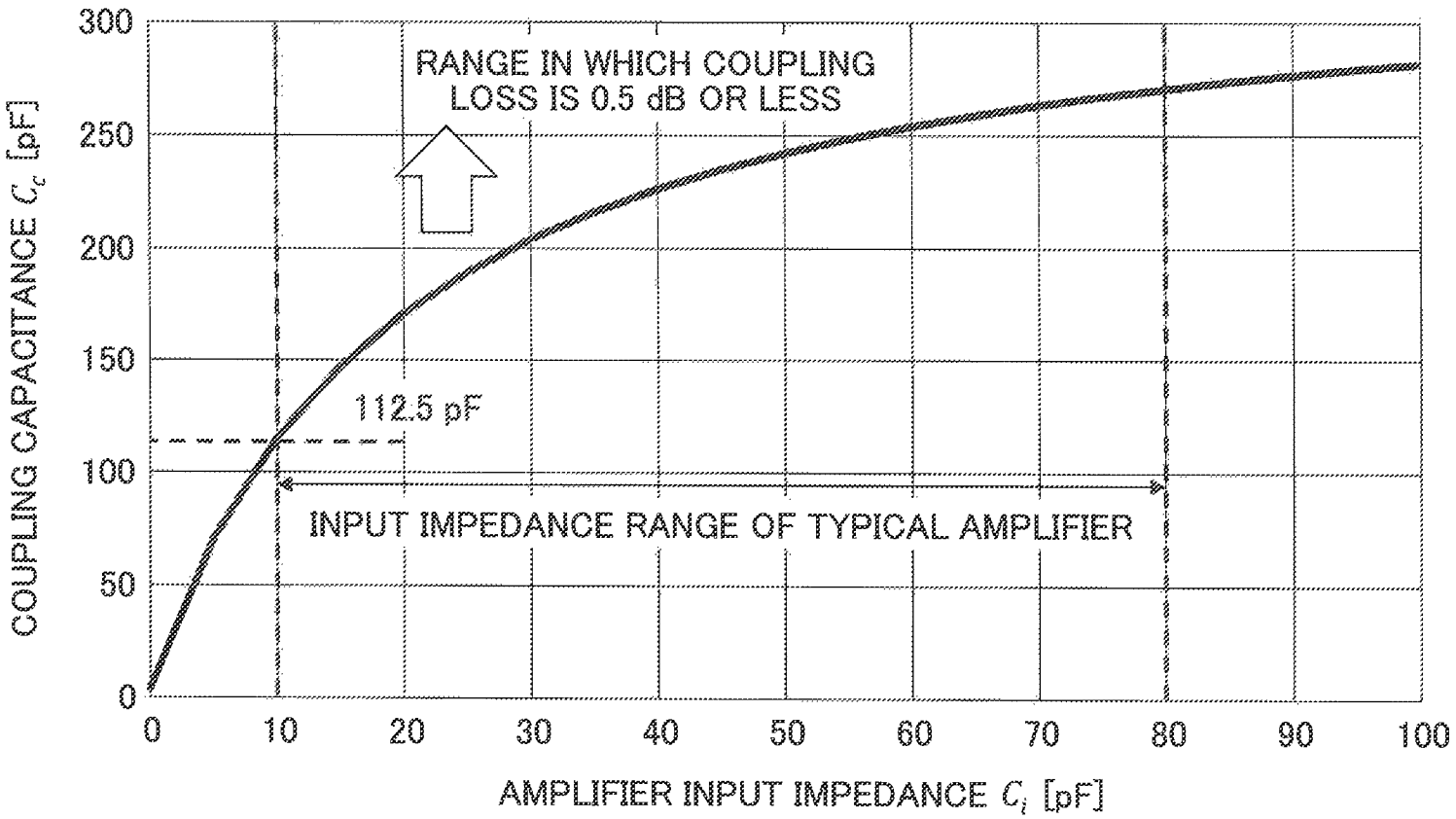
FIG. 12 is a diagram showing an example of a result of simulation measuring a relation between the input capacitance of the amplifier and the coupling capacitance, where the coupling loss is 0.5 dB.

FIG. 9 is a diagram showing an example of a result of a simulation measuring a relation between an input capacitance $C_i$ of the amplifier 60 and the coupling capacitance $C_c$, where the coupling loss is 3.0 dB. FIG. 10 is a diagram showing an example of a result of simulation measuring a relation between an input capacitance $C_i$ of the amplifier 60 and the coupling capacitance $C_c$, where the coupling loss is 2.0 dB. FIG. 11 is a diagram showing an example of a result of simulation measuring a relation between an input capacitance $C_i$ of the amplifier 60 and the coupling capacitance $C_c$, where the coupling loss is 1.0 dB. FIG. 12 is a diagram showing an example of a result of simulation measuring a relation between an input capacitance $C_i$ of the amplifier 60 and the coupling capacitance $C_c$, where the coupling loss is 0.5 dB. Curves shown in FIGS. 9 to 12 are expressed by the following formula 2.

[Math 1C]

$$C_c = \frac{C_i \times C_a \times \frac{v_{xdB}}{v_a}}{\left(C_a - (C_a + C_i) \times \frac{v_x dB}{v_a}\right)} \quad \text{(formula 2)}$$

A curve shown in FIG. 9 indicates the case where x=3.0 for $v_{xdB}$, a curve shown in FIG. 10 indicates the case where x=2.0 for $v_{xdB}$, a curve shown in FIG. 11 indicates the case where x=1.0 for $v_{xdB}$, and a curve shown in FIG. 12 indicates the case where x=0.5 for $v_{xdB}$. Because typically an antenna capacitance of an antenna element for receiving AM broadcasting wave falls within a range from 20 pF to 80 pF, the antenna capacitance $C_a$ in FIGS. 9 to 12 is set to the minimum value of the range (i.e. 20 pF). Moreover, typically an input capacitance of an amplifier falls within a range from 10 pF to 80 pF.

Thus, as illustrated in FIG. 9, for example, in the case of using an amplifier 60 with an input capacitance $C_i$ of 10 pF, by designing the antenna so that the coupling capacitance $C_c$ is 16.2 pF or more, the coupling loss can be made 3.0 dB or less, and the receiving sensitivity of the amplifier 60 can be enhanced. Moreover, as illustrated in FIG. 10, for example, in the case of using an amplifier 60 with an input capacitance $C_i$ of 10 pF, by designing the antenna so that the coupling capacitance $C_c$ is 25.7 pF or more, the coupling loss can be made 2.0 dB or less, and the receiving sensitivity of the amplifier 60 can be enhanced. Moreover, as illustrated in FIG. 11, for example, in the case of using an amplifier 60 with an input capacitance $C_i$ of 10 pF, by designing the antenna so that the coupling capacitance $C_c$ is 54.6 pF or more, the coupling loss can be made 1.0 dB or less, and the receiving sensitivity of the amplifier 60 can be enhanced. Moreover, as illustrated in FIG. 12, for example, in the case of using an amplifier 60 with an input capacitance $C_i$ of 10 pF, by designing the antenna so that the coupling capacitance $C_c$ is 112.5 pF or more, the coupling loss can be made 0.5 dB or less, and the receiving sensitivity of the amplifier 60 can be enhanced.

In a planar view in the thickness direction of the dielectric, the coupling capacitance $C_c$ is larger in accordance with an area where the internal electrode 31 and the external electrode 32 overlap with each other (in the following, also referred to as an "overlapping area A") being larger. Thus, the overlapping area A is preferably larger in reducing the coupling loss. However, when an upper limit of the overlapping area A is calculated taking into account an upper limit of an area of the glass plate or the dielectric substrate, an upper limit of the coupling capacitance $C_c$ is about 3500 pF.

Figure 13:
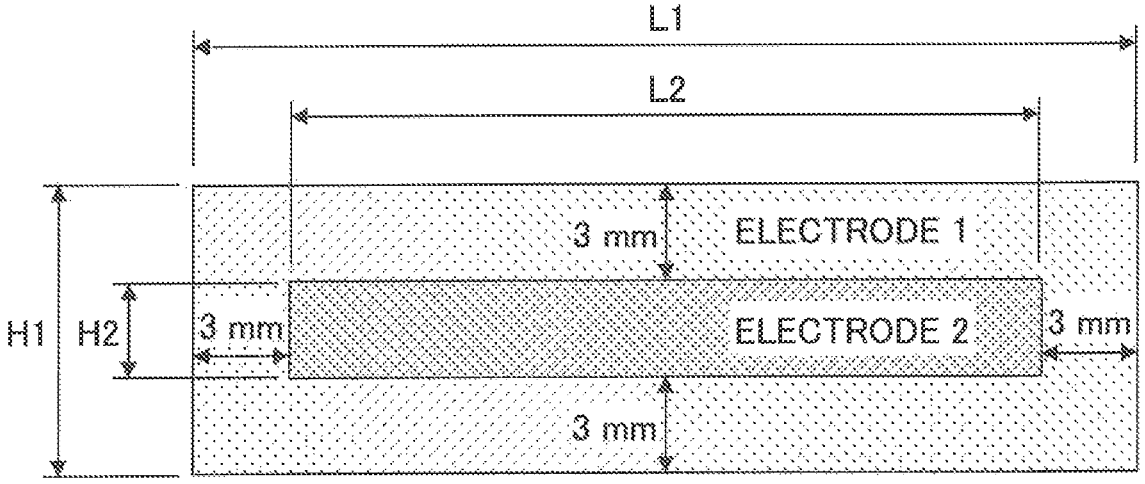
FIG. 13 is a diagram illustrating a mode in which two electrodes of a capacitance coupling portion overlap with each other, in a planar view.

FIG. 13 is a diagram depicting a configuration in which two electrodes of the capacitive coupling part overlap with each other in the planar view. In FIG. 13, an electrode among the internal electrode 31 and the external electrode 32 having a larger area is set to an electrode 1, and an electrode having a smaller area is set to an electrode 2. FIG. 14 is a diagram depicting an example of a result of simulation for dimensions of respective parts for each shape of the electrode, where the coupling capacitance $C_c$ is 54 pF. When the coupling capacitance $C_c$ is 54 pF or more, as described above, the coupling loss can be made about 1 dB or less. FIG. 14 shows three cases: the electrodes 1 and 2, illustrated in FIG. 13, having rectangular shapes (pattern #1 and pattern #2) and having square shapes (pattern #3). As assumptions of the simulation, the dielectric between the electrode 1 and the electrode 2 had a thickness of 1.6 mm and a dielectric constant of 8.0. The electrode 2 had a shape in which an outer edge of the electrode 2 was shifted inward from an outer edge of the electrode 1 by 3 mm, taking into account variation in sizes of the electrodes 1 and 2 in manufacturing. The maximum length L1 of the electrode 1 was set to 1600 mm taking into account the maximum width of a rear glass of the vehicle in the vehicle width direction. The maximum width H1 of the electrode 1 was set to 50 mm taking into account the maximum width of the light shielding film 13. The area of the electrode 1 is denoted by S1, and the area of the electrode 2 is denoted by S2.

When the maximum area of the electrode 1 (maximum value of the area S1) is 80000 $mm^2$, which is a product of 1600 mm (length) and 50 mm (width), the overlapping area A where the coupling capacitance $C_c$ is 16.2 pF or more was calculated to be 366 $mm^2$ or more. Thus, the ratio S of the overlapping area A is only required to be 0.46% or more for the electrode 1. That is, in order to make the coupling loss 3.0 dB or less, the overlapping area A is preferably 366 $mm^2$ or more, or the ratio S of the overlapping area A is preferably 0.46% or more for the electrode 1. Moreover, in order to make the coupling loss 2.0 dB or less, according to the simulation, the overlapping area A is preferably 582 $mm^2$ or more, or the ratio S of the overlapping area A is preferably 0.73% or more for the electrode 1. In order to make the coupling loss 1.0 dB or less, according to the simulation, the overlapping area A is preferably 1220 $mm^2$ or more, or the ratio S of the overlapping area A is preferably 1.5% or more for the electrode 1. Moreover, in order to make the coupling loss 0.5 dB or less, according to the simulation, the overlapping area A is preferably 2520 $mm^2$ or more, or the ratio S of the overlapping area A is preferably 3.1% or more for the electrode 1.

When the overlapping area A is 366 $mm^2$ and the width H2 of the electrode 2 is 10 mm, the length L2 of the electrode 2 is 36.6 mm. Thus, in order to make the coupling loss 3.0 dB or less, the electrode 2 preferably has a length L2 of 36.6 mm or more in the vehicle width direction. Moreover, when the overlapping area A is 582 $mm^2$ and the width H2 of the electrode 2 is 10 mm, the length L2 of the electrode 2 is 58.2 mm. Thus, in order to make the coupling loss 2.0 dB or less, the electrode 2 preferably has a length L2 of 58.2 mm or more in the vehicle width direction. Moreover, when the overlapping area A is 1220 $mm^2$ and the width H2 of the electrode 2 is 50 mm, the length L2 of the electrode 2 is 24.4 mm. Thus, in order to make the coupling loss 1.0 dB or less, the electrode 2 preferably has a length L2 of 24.4 mm or more in the vehicle width direction.

As described above, the window glass for a vehicle and the antenna have been described by the embodiments. The present invention is not limited to the embodiments. Various variations and enhancements, such as combination/replacement with/by a part or whole of another embodiment may be made without departing from the scope of the present invention.

REFERENCE SIGNS LIST

10 glass plate (example of first glass plate); 13 light shielding film; 20 glass plate (example of second glass plate or dielectric); 21 plate surface (example of first surface); 22 plate surface (example of second surface); 23 dielectric substrate (example of dielectric); 31 internal electrode (example of first electrode); 32 external electrode (example of second electrode); 40 intermediate film; 41 intermediate film (example of first layer); 42 intermediate film (example of second layer); 43 bonding layer; 50 conductive film; 51,52 bus bar; 55 heater; 56 lattice part; 60,61 amplifier; 70 antenna; 71,72,73 antenna element; 100 window glass

What is claimed is:

1. A window glass for a vehicle comprising:

a glass plate;

a dielectric having a first surface on a side facing the glass plate, and a second surface on a side opposite to the first surface;

a first electrode arranged between the glass plate and the first surface of the dielectric;

a second electrode arranged on a second surface side of the dielectric such that the dielectric is interposed between the first electrode and the second electrode; and an antenna element arranged between the glass plate and the first surface of the dielectric, and connected to the first electrode, wherein the antenna element receives at least an electromagnetic wave in a frequency band of amplitude modulation (AM) broadcasting, and wherein when a coupling capacitance between the first electrode and the second electrode is denoted by $C_c$, an antenna capacitance of the antenna element is denoted by $C_a$, an input capacitance of an amplifier connected to the second electrode is denoted by $C_i$, a voltage value, which is lower by x decibels than a voltage value output from the second electrode when the coupling capacitance $C_c$ is infinity is denoted by $v_{xdB}$, and a reception voltage value of the antenna element is denoted by $v_a$, a value of x is 3.0 or less, and the coupling capacitance $C_c$ satisfies formula 1:

$$C_c \geq \frac{C_i \times C_a \times \frac{v_{xdB}}{v_a}}{\left(C_a - (C_a + C_i) \times \frac{v_x dB}{v_a}\right)}. \quad \text{(formula 1)}$$

2. The window glass of claim 1, wherein a ratio of an area of a part where the first electrode and the second electrode overlap with each other, in a planar view in a thickness direction of the dielectric, to a larger area from among an area of the first electrode and an area of the second electrode is 0.46% or more.

3. The window glass of claim 2, wherein the larger area from among the area of the first electrode and the area of the second electrode is 1675 $mm^2$ or more.

4. The window glass of claim 1, wherein the area of the part where the first electrode and the second electrode overlap with each other is 366 $mm^2$ or more.

5. The window glass of claim 1, wherein the area of the part where the first electrode and the second electrode overlap with each other is 582 $mm^2$ or more.

6. The window glass of claim 1, wherein the area of the part where the first electrode and the second electrode overlap with each other is 1220 $mm^2$ or more.

7. The window glass of claim 1, wherein the area of the part where the first electrode and the second electrode overlap with each other is 2520 $mm^2$ or more.

8. The window glass of claim 1, wherein the value of x is 2.0 or less.

9. The window glass of claim 1, wherein the value of x is 1.0 or less.

10. The window glass of claim 9, wherein the value of x is 0.5 or less.

11. The window glass of claim 1, wherein the glass plate includes a light shielding film that overlaps with at least one of the first electrode and the second electrode in a thickness direction of the glass plate.

12. The window glass of claim 1, wherein the glass plate is a first glass plate, and the dielectric is a second glass plate, and wherein the window glass has a laminated glass structure in which the first glass plate and the second glass plate are bonded to each other via an intermediate film.

13. The window glass of claim 12, wherein the first electrode contacts the intermediate film.

14. The window glass of claim 12, wherein the intermediate film includes a first layer and a second layer, and wherein the first electrode is located between the first layer and the second layer.

15. The window glass of claim 1, wherein at least one of the first electrode and the second electrode have linear portions with a longitudinal direction directed in a direction which will be a vehicle width direction.

16. The window glass of claim 1, wherein an electrode among the first electrode and the second electrode, an area of the electrode being a smaller area from among an area of the first electrode and an area of the second electrode, has a length of 24.4 mm or more in a direction which will be a vehicle width direction.

17. The window glass of claim 1, wherein the input capacitance of the amplifier connected to the second electrode, $C_i$, is 10 pF or more and 80 pF or less.

18. The window glass of claim 1, wherein the antenna capacitance of the antenna element, $C_a$, is 20 pF or more and 80 pF or less.

19. An antenna comprising:

a dielectric having a first surface, and a second surface on a side opposite to the first surface;

a first electrode arranged on a first surface side of the dielectric or inside the dielectric;

a second electrode arranged on a second surface side of the dielectric such that at least a part of the dielectric is interposed between the first electrode and the second electrode; and an antenna element arranged on the first surface side of the dielectric or inside the dielectric, and connected to the first electrode, wherein the antenna element receives at least an electromagnetic wave in a frequency band of amplitude modulation (AM) broadcasting, and wherein when a coupling capacitance between the first electrode and the second electrode is denoted by $C_c$, an antenna capacitance of the antenna element is denoted by $C_a$, an input capacitance of an amplifier connected to the second electrode is denoted by $C_i$, a voltage value, which is lower by x decibels than a voltage value output from the second electrode when the coupling capacitance $C_c$ is infinity is denoted by $v_{xdB}$, and a reception voltage value of the antenna element is denoted by $v_a$, a value of x is 3.0 or less, and the coupling capacitance $C_c$ satisfies formula 1:

$$C_c \geq \frac{C_i \times C_a \times \frac{v_{xdB}}{v_a}}{\left(C_a - (C_a + C_i) \times \frac{v_x dB}{v_a}\right)}. \quad \text{(formula 1)}$$

20. The antenna of claim 19, wherein the area of the part where the first electrode and the second electrode overlap with each other is 366 $mm^2$ or more.

* * * * *